US005228506A

United States Patent [19]

Pearce

[11] Patent Number: 5,228,506

[45] Date of Patent: Jul. 20, 1993

[54] SPILL COLLECTION SYSTEM FOR WELLHEADS

[76] Inventor: Stevan E. Pearce, 3016 Montgomery St., Hobbs, N. Mex. 88240

[21] Appl. No.: 802,152

[22] Filed: Dec. 4, 1991

[51] Int. Cl.[5] ..... E21B 33/08

[52] U.S. Cl. ..... 166/81

[58] Field of Search ..... 166/81, 75.1, 379

[56] References Cited

U.S. PATENT DOCUMENTS

| | | | |
|---|---|---|---|
| 1,334,678 | 3/1920 | Riley | 137/312 X |
| 1,390,793 | 9/1921 | Kyle et al. | 166/81 |
| 1,507,628 | 9/1924 | Schuyler | 166/84 |
| 1,590,911 | 6/1926 | Russell | 137/312 |
| 2,934,003 | 4/1960 | Ladymon | 101/1 |
| 3,733,641 | 5/1973 | Brown | 15/210 B |
| 4,029,160 | 6/1977 | Leidvik | 175/210 |
| 4,224,985 | 9/1980 | Rapson | 166/57 |
| 4,247,312 | 1/1981 | Thakur et al. | 175/206 X |
| 4,406,331 | 9/1983 | Bentley | 175/84 |
| 4,428,841 | 1/1984 | Favret, Jr. | 210/747 |
| 4,493,382 | 1/1985 | Collins et al. | 175/206 |
| 4,553,637 | 11/1985 | Tanner | 184/15.1 |
| 4,690,213 | 9/1987 | Stannard et al. | 166/84 |
| 4,872,508 | 10/1989 | Gordon | 166/84 |
| 4,941,551 | 7/1990 | Visser | 184/106 |
| 4,949,784 | 8/1990 | Evans | 166/81 |
| 4,982,787 | 1/1991 | Reddoch | 166/82 |
| 5,121,794 | 6/1992 | Hibdon et al. | 166/81 |
| 5,121,796 | 6/1992 | Wigington, Sr. | 166/81 X |

*Primary Examiner*—Hoang C. Dang

*Attorney, Agent, or Firm*—Marcus L. Bates

[57] ABSTRACT

A collection system for accumulating spills from a well rig that is working on a wellbore, and accumulates the spills in a suitable storage vessel. The floor of the rig is located above the wellhead of a wellbore, and the collection system is located therebetween to intercept spills from the work-over or drilling rig. The collection system has a framework supported from the well head. A sloped plate collector member is supported by the well-head and is located within a framework. The framework supports a panel member which intercepts spills and other debris, and directs the spills to an outlet in the sloped plate member through which spills gravitates to the storage vessel.

3 Claims, 3 Drawing Sheets

SPILL COLLECTION SYSTEM FOR WELLHEADS

BACKGROUND OF THE INVENTION

Drilling rigs and work-over rigs handle a large quantity of crude oil to which corrosion inhibitors have been added, large quantities of salt water, as well as drilling mud having various additives therein, all of which may be saturated with sour gas. It is no easy task to withdraw thousands of feet of tubular goods from a borehole and not spill some of this material that clings to the pipe. This is especially so when working in the west Texas winds or the rain storms of the eastern United States. Some of the material is viscous and clings to the piping as it is withdrawn from the borehole, where it then runs onto the rig floor and dribbles onto the ground, or is blown by the wind, and eventually a substantial amount is left to contaminate the immediate surroundings.

It is next to impossible to pull a wet tubing string in the manner presently demanded by industry and not spill a considerable amount of well fluids onto the rig floor where it subsequently runs off onto the adjacent land. Historically, the area surrounding the rig is a quagmire by the time the rig completes the job and leaves the drilling location. It would be advantageous to have made available a logical system for economically intercepting spills below the drill floor of the drilling and work-over rigs before any of the material touches the ground.

Apparatus by which this can be accomplished is the subject of the present invention.

SUMMARY OF THE INVENTION

This invention relates to a spill collection system associated with a well drilling or work-over rig and the wellhead of a borehole. Broadly, the spill collection system comprises flexible panels attached to a framework that is supported from the wellhead for collecting spilled material resulting from work carried out on the borehole. The spilled material includes fluids and other debris which are caught by the collection system and then the caught material gravitates to a suitable storage vessel.

More specifically, the collection system of this invention has a framework supported from the wellhead of a borehole. The collection system is positioned above the ground and below a rig floor of a work-over rig or the like. The framework supports an impervious panel having a surface arranged to collect spills, and gravitate the collected material to a storage vessel. The collected material is subsequently disposed of in an approved manner.

In one specific embodiment of the invention, a sloped collection member is attached to the wellhead of a borehole and a concave, flexible outer panel member is attached to and surrounds the collection member. The flexible panel and collection member present an upper surface that intercepts spills, and gravitates the caught material into an outlet in the collection member, and then into a storage vessel where the caught material can be treated, returned to the wellbore or disposed of in a suitable manner.

A primary object of the present invention is the provision of a spill collection system for use with a drilling rig or a workover rig and which is attached to the wellhead associated with a borehead for collecting spilled fluids that result from work carried out on the borehole.

Another object of this invention is to disclose and provide a sloped collection member that is attached to the wellhead of a borehole, and a flexible outer panel member that is attached to a framework that surrounds the collection member and presents an upper surface for intercepting spills from a drilling or workover rig. The spills gravitate from the outer panel member onto the collection member and then into a storage or separation vessel.

The above objects are carried out in accordance with the present invention by the provision of a spill collection apparatus associated with a well rig and the wellhead of a borehole. The spill collection apparatus has a framework and collection member supported from the wellhead of a borehole. The framework and collection member are connected together and support a flexible panel member. The framework, flexible panel member and collection member are positioned above the ground and below the floor of a workover rig or the like. The flexible panel member is attached to the framework and to the collection member and presents an upper surface that intercepts spills which gravitates onto the collection member and into a storage and treatment vessel.

These and various other objects and advantages of the invention will become readily apparent to those skilled in the art upon reading the following detailed description and claims and by referring to the accompanying drawings.

The above objects are attained in accordance with the present invention by the provision of a combination of elements which are fabricated in a manner substantially as described and claimed herein.

DETAILED DESCRIPTION OF THE PREFERRED EMBODIMENTS

Figures 1, 3:
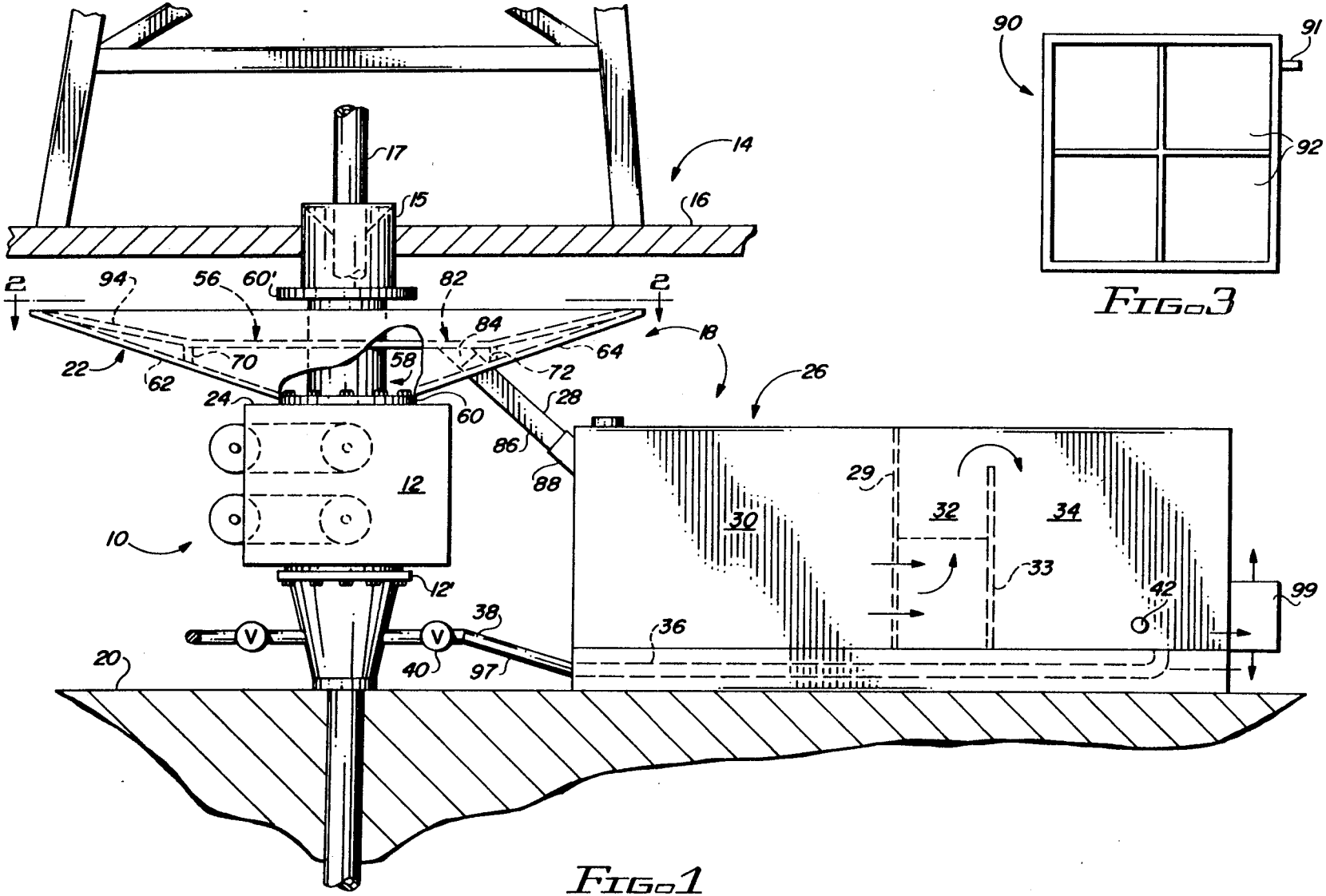
FIG. 1 is a fragmentary, part cross sectional, broken, side elevational view of the present invention in combination with a well rig and wellhead of a wellbore.
FIG. 3 is a top plan view of a device for use in conjunction with apparatus disclosed in the foregoing figures.

This invention relates to a spill collection system for a producing well or wellbore 10 having a casing 11 that terminates in a blow-out preventor 12 that forms the wellhead thereof. The spill collection system is associated with a well rig 14 and the wellhead 12, either of which can take on any number of different forms. The well rig 14 has the usual turntable 15, rig floor 16 and drill string, production tubing, or other piping 17. The spill collection system is broadly indicated by the arrows at numeral 18, and comprises an apparatus removably supported from the wellhead 12 of a wellbore 10 for collecting spilled fluids that result from work carried out on the wellbore. The fluids and debris caught by the collection system 18 gravitate to a suitable storage or treatment vessel 26 supported on the surface of the ground 20.

More specifically, the collection system 18 of this invention has a collection member 22 supported from a wellhead 12 that is attached to and forms the upper terminal end of a casing 11. The collection member 22 is positioned above ground level 20 and below the rig floor 16 of well rig 14, which can be a work-over rig or the like. The collection member 22 has a framework that supports an impervious surface which intercepts and directs the spills to a suitable container. In FIG. 1 the collected material is gravitated to a collection or storage vessel 26 where the collected material is separated, treated and subsequently disposed of a suitable manner.

The spill collection system 18 is supported above ground level 20 and includes a collection member 22 having a framework attached to the upper end 24 of a wellhead, symbolically shown herein as a blow-out preventor (BOP). The collection member 22 broadly resembles an inverted umbrella-like structure.

Vessel 26 is supported on the ground 20 in underlying relationship respective to collection member 22 and preferably is a portable, skid mounted tank. A drain outlet 28 extends from collection member 22 into chamber 30 of vessel 26 for gravitating spilled material caught on collection member 22 into vessel 26.

The vessel 26 has a screen 29 that separates a chamber 30 from a central chamber 32, and further includes a baffle 33 that separates a chamber 34 from the aforesaid chamber 32. Screen 29 is of a size to admit flow of fluid therethrough while precluding flow of large particles of sand and other debris therethrough. Outlet pipe 36 is positioned to gravitate liquid from chamber 34, through outlet piping 38, flow control valve 40, and into the annulus between casing 11 tubing 17. Outlet 42 enables a suction truck to withdraw the contents of chamber 34, if desired.

Figure 2:
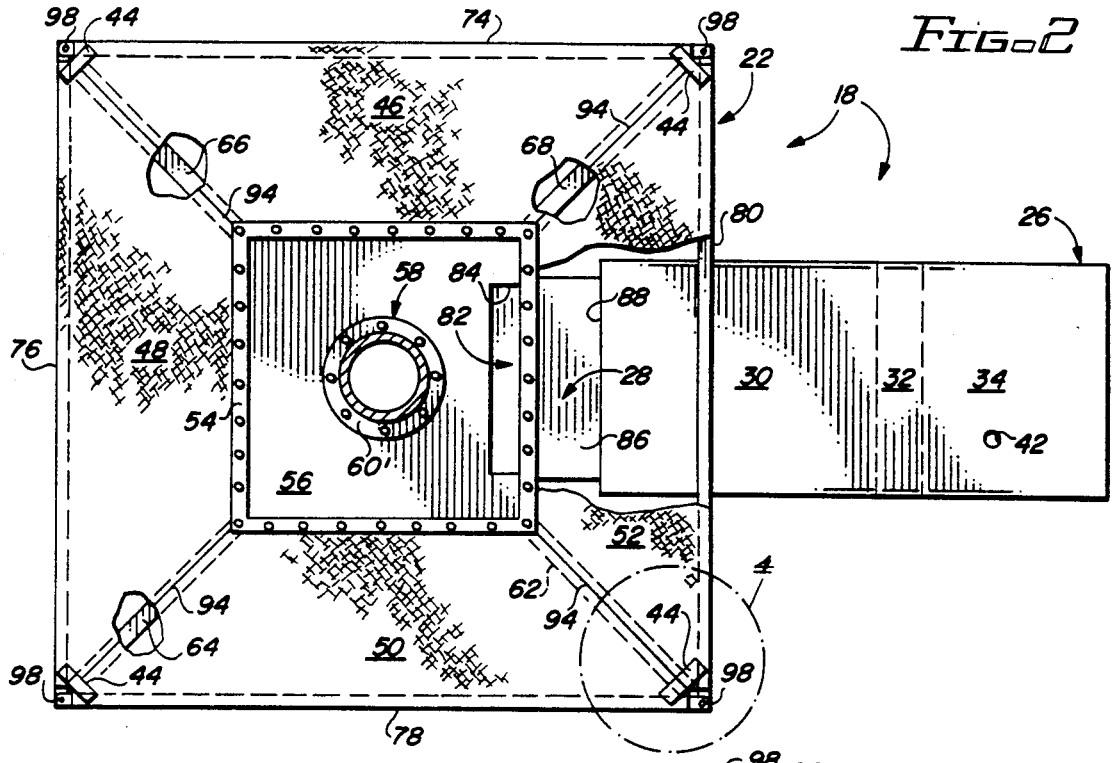
FIG. 2 is a cross-sectional view taken along line 2—2 of FIG. 1, with some parts being broken away therefrom to more fully disclose what lies therebeyond.
Figure 4:
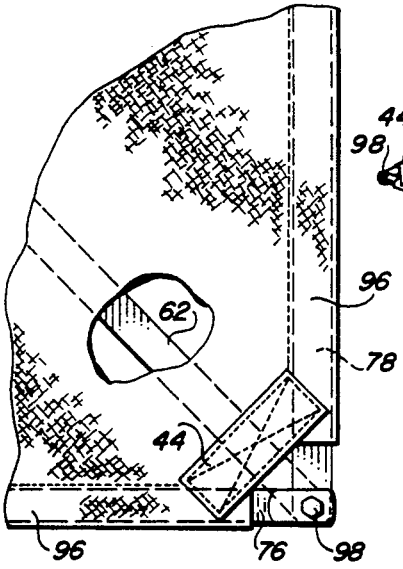
FIG. 4 is an enlarged, fragmentary, top view showing a detail of part of the apparatus disclosed in FIG. 1.
Figure 5:
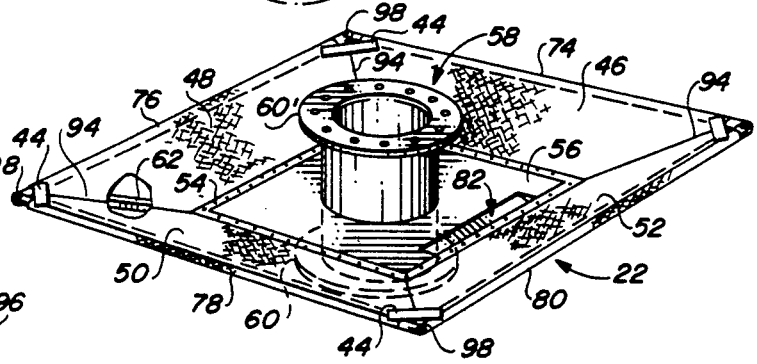
FIG. 5 is a perspective, detailed view of part of the apparatus disclosed in FIGS. 1 and 2, with some parts thereof being removed therefrom to disclose hidden details thereof.

In FIG. 2, in conjunction with the other figures of the drawing, collection member 22 includes the illustrated framework that is provided with reinforced corners 44, the details of which are more fully presented in the enlarged illustration of FIG. 4. The collection member framework supports flexible panel members seen at 46, 48, 50 and 52. The panel members are connected to form a continuous surface of rectangular configuration. The outer edge of the panel members is attached to the framework and extends about and has an inner edge that is attached at 54 to a centrally located plate member 56. Attachment 54 of the flexible panel members 46, 48, 50, 52 to plate member 56 can be achieved by any suitable known means. A central annular member 58, having opposed axially aligned flanges 60, 60', is bolted onto the well-head 12. The annular member 58 has a medial part rigidly affixed to collection plate member 56, as for example, by welding.

In FIGS. 1, 2, 4 and 5, the framework of collection member 22 includes angle braces 62, 64, 66, 68 attached to lower flange 60 of annular member 58. Braces 62, 64, 66, 68 upwardly extend into contact with the outer frame member to support the corners at fastener 98. The outer frame members 74, 76, 78 and 80 form the outer periphery that describes the outer edge of the collection member framework. Intermediate braces 70, 72 are connected between the angle braces 62, 64, 66, 68 and the collection plate member 56 and add to the structural integrity of the apparatus. Collection plate member 56 is apertured at 82, with the aperture extending to opposed edges 84. Downwardly sloped square flow conduit 86 is affixed to outlet 82 and telescopically extends into inlet 88 of vessel 26.

As seen in FIGS. 3 and 4, an optional apparatus 90 is provided for supporting the ends of the individual pipe as the string of pipe is pulled from the borehole. Numeral 91 is a drain that is directed toward the turntable 15 so that fluid from the tubing can be diverted to collection system 18. Drain 19 can instead be directly connected to vessel 26 or alternatively to flow line 97 of FIG. 1.

As specifically shown in FIG. 4, the outer marginal edge of each panel is formed into a seamed passageway 96 within which outer frame member 78 is received. Fastener 98 is located at each corner of the framework and fastens angle brace 62 to outer frame members 76 and 78.

Figure 6:
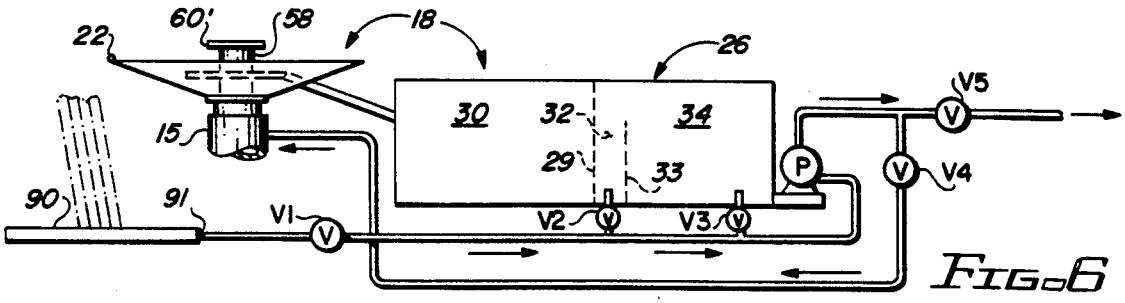
FIG. 6 is a diagrammatical representation of a flow system associated with the apparatus of FIG. 1.

FIG. 6 is a schematical representation that sets forth a flow diagram of the first embodiment of the invention, wherein the collection system 18 is positioned in the before described manner with central annular member 58 being attached to wellhead 12 to thereby position the framework of collection member 22 between the ground 20 and the rig floor 16. Spilled fluid collected in collection member 22 gravitates down sloped panels 46, 48, 50, 52, onto the centrally located sloped plate member 56, through outlet 82, where the spilled material gravitates into primary chamber 30 of vessel 26.

The heavy material separates from the liquid and the separated liquid flows through screen 29 into central chamber 32. As the fluid level in chamber 30 rises, the fluid contained within chamber 32 likewise rises and overflows baffle 33, so that the resultant liquid contained within chamber 34 is relatively clean and can be transferred back into the borehole annulus if desired, or through valve V5 into a transport truck and carried to a suitable disposal facility, such as a disposal well. Valve V2 and V3 are interconnected with valve V1, V4 and V5 such that flow between the various components of the system can be effected by pump P and thereby transfer the collected spill as may be desired.

Figure 7:
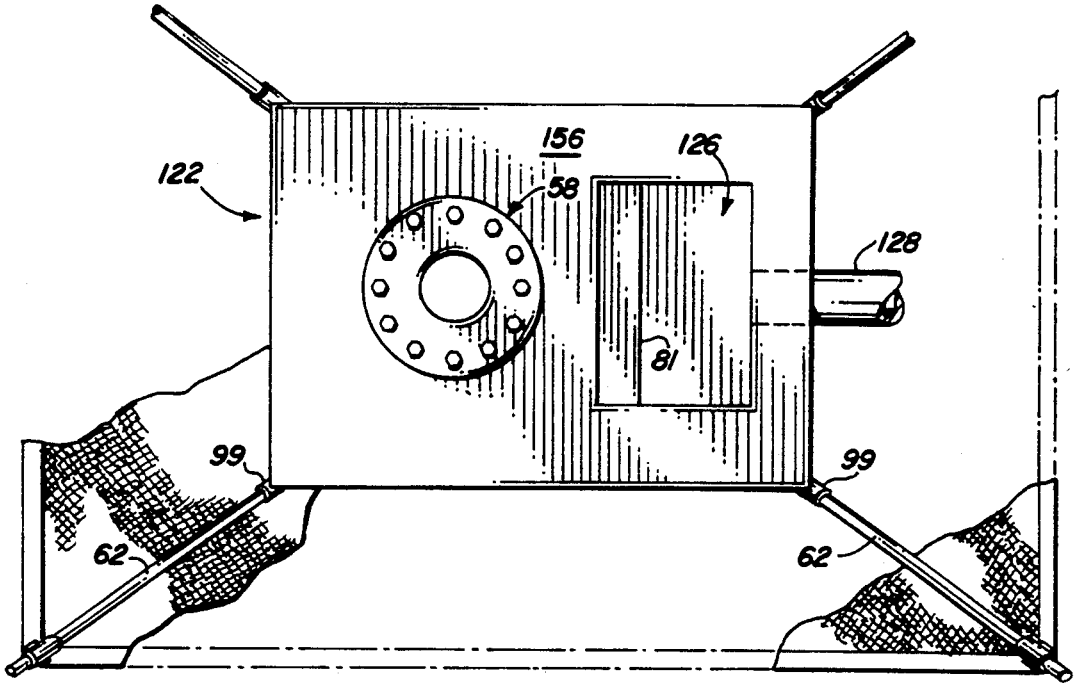
FIG. 7 is a fragmentary, top plan view of an alternate embodiment of the invention, with some parts being broken away therefrom to conserve drawing space and to disclose additional details thereof.
Figure 8:
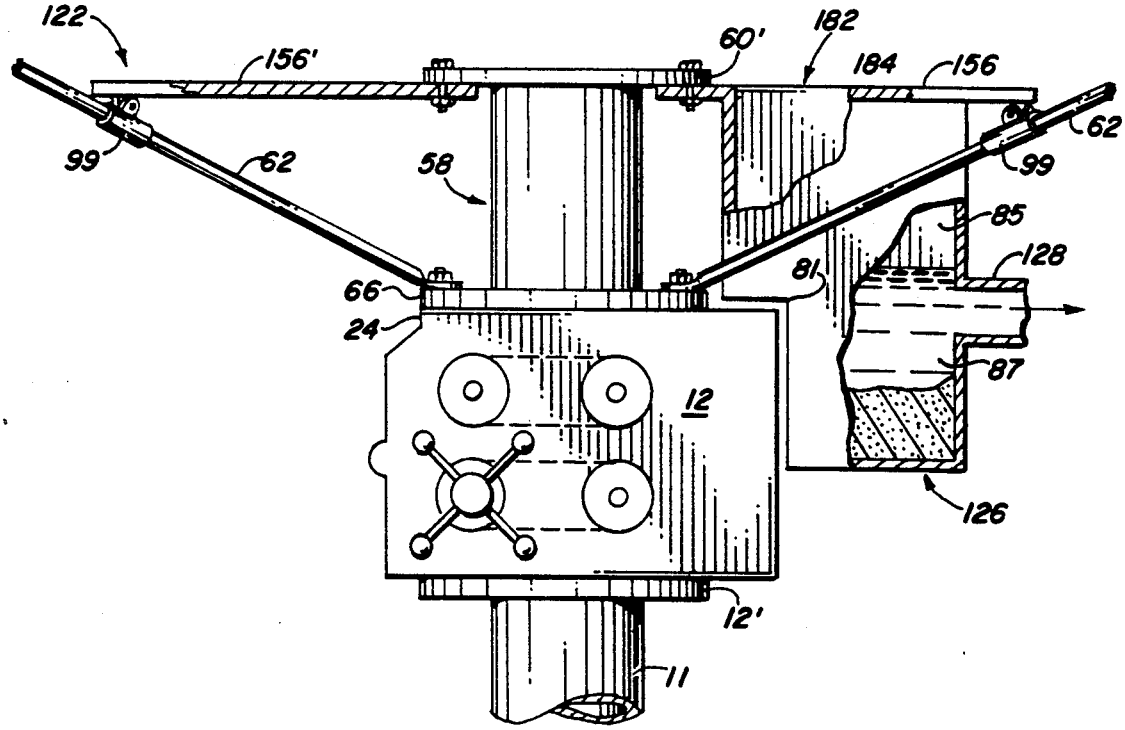
FIG. 8 is a broken, part cross-section side view of the apparatus of FIG. 7.

In the embodiment of the invention set forth in FIGS. 7 and 8, like or similar numerals will refer to like or similar elements previously used in conjunction with FIG. 1–6. The collection member 122 of the collection system 118 is mounted to BOP 12 that forms the wellhead in the before described manner of the first embodiment of the invention by employment of the illustrated annular member 58. The lower flange 60 of annular member 58 is attached to BOP 12 which in turn is attached to flange 12' located at the upper end of casing 11. The upper flange 60' of annular member 58 is attached to support the bowl 15 located centrally of the turn table. The sloped plate member 156 is provided with a rectangular port that forms an inlet 182 leading into chamber 85 of the separation vessel 126. Outlet 128 can be connected to storage vessel 26 of FIG. 1 by interconnecting outlet 128 of vessel 126 and chamber 30 of vessel 26. Alternatively, outlet 128 can be connected to the wellbore annulus.

Sleeves 99 at each corner of sloped plate member 156 slidably receive angle brace 62 therewithin, with the lower end of angle brace 62 being attached to one of the studs of the bolt circle of lower flange 60. The upper end of angle brace 62 is attached to one of the outer frame member 74, 76, 78, 80. Sleeves 99 preferably is articulated for self-alignment.

Vessel 126 has a step 81 cut therein for accommodating part of the wellhead or BOP 12 therein. Outlet 128 is located to form upper and lower chambers 85 and 87; thereby providing ample volume for settlement of sludge to the bottom thereof so that the fluid at outlet 128 can sometime be returned directly into the casing of the wellbore, or alternatively, directed into a treatment vessel such as seen at 26 of FIG. 1 for further treatment or disposal.

The present system enables relatively clean liquid to be accumulated in chamber 34 or 87 so that most of the accumulated spills can be treated and returned to the wellbore, with the heavier material being separated and accumulated in a suitable vessel chamber so that it can be concentrated and appropriately disposed of at significantly reduced prices.

In operation of the embodiments set forth in the Figures, vessel 26 is transported to the well site and set on the ground 20 at a location closely adjacent the wellhead 12. Next, annular member 58 is attached to the upper end 24 of the wellhead BOP 12. The annular member 58 is spaced-out such that the rig turntable 15 is accessible from floor 16 as dictated by the driller of the work-over rig. Where no BOP is present to form wellhead 12, it is necessary to substitute a suitable annular flanged spacer in order to properly position the collection member 22 and turntable 15 respective to floor 16 and ground level 20. The remaining framework and panels are assembled and the sloped plate member 56 is connected at 28 to vessel 26.

I claim:

1. A collection system having a collection member removably attached to a wellhead for intercepting spill material between the floor of a well rig and the ground;

said collection member having an outlet formed therein, an annular support member removably connected to an upper end of a well head; said annular support member having a lower end attached to the well head with the collection member being attached to said annular support member at a location to mount said collection member in underlying relationship respective to the rig floor;

a framework support from said annular support member and positioned to surround said collection member; a panel attached to said framework such that the panel slopes towards said collection member;

said collection member being an apertured plate member that receives the annular member therewithin; said panel being a flexible fabric-like material that extends from the outer edge of the collection member to the framework;

whereby, spills from the well rig are caught on the upper surface of the panel and gravitate onto the collection member, through the outlet, and to suitable disposal means.

2. In a well rig having a rig floor located above a wellhead of a wellbore, the combination with said wellhead and well rig of a collection system by which spills are intercepted and contained and contamination of the surrounding area is obviated;

said collection system including an annular support member, a framework supported from said annular support member, said framework including an outer periphery framework and an inner framework, said outer periphery framework being supported by said inner framework, said annular support member being removably attached to the upper end of the wellhead;

an apertured rigid plate member for intercepting spills, including liquid and debris; the aperture of said apertured rigid plate member rigidly receiving said annular support member attached therewithin, with said plate member circumferentially extending about said annular support member; and outlet formed in said rigid plate member;

a flexible panel member having an inner edge attached to and extending about the outer periphery of said plate member, said flexible panel member being made of fabric-like material and having an outer marginal edge attached to the outer periphery framework;

said framework and said flexible panel member being arranged respective to said plate member to cause spills to be caught on the upper surface of the panel member and to gravitate down to the plate member, into the plate member outlet, and to a suitable disposal means.

3. The combination of claim 2 wherein said disposal means is a vessel having a first chamber, a baffled chamber, and an outlet chamber adjacent the baffled chamber;

a screen between the first chamber and the baffled chamber, the baffled chamber has an opening at the upper end of the chamber for flow into the outlet chamber, whereby, solids are deposited in said first chamber and relatively clean liquid accumulates in the outlet chamber.

* * * * *